US007097332B2

(12) United States Patent
Vamberi

(10) Patent No.: US 7,097,332 B2
(45) Date of Patent: Aug. 29, 2006

(54) LIGHT FIXTURE WITH FINS

(76) Inventor: Gabor Vamberi, 9670 Farmside Pl., Vienna, VA (US) 22182

( * ) Notice: Subject to any disclaimer, the term of this patent is extended or adjusted under 35 U.S.C. 154(b) by 177 days.

(21) Appl. No.: 10/656,417

(22) Filed: Sep. 5, 2003

(65) Prior Publication Data

US 2005/0052870 A1 Mar. 10, 2005

(51) Int. Cl.
*F21S 8/06* (2006.01)

(52) U.S. Cl. ..... 362/405; 362/147; 362/294; 362/373; 362/404

(58) Field of Classification Search ..... 362/147, 362/241, 242, 243, 290, 291, 294, 363, 370, 362/371, 373, 404, 405
See application file for complete search history.

(56) References Cited

U.S. PATENT DOCUMENTS

| | | | | | |
|---|---|---|---|---|---|
| 3,950,639 | A | | 4/1976 | Van Steenhoven | 240/92 |
| 4,330,814 | A | | 5/1982 | Baldwin et al. | 362/267 |
| 4,494,175 | A | * | 1/1985 | Gawad et al. | 362/150 |
| 4,750,096 | A | * | 6/1988 | Lim | 362/218 |
| 4,872,097 | A | * | 10/1989 | Miller | 362/226 |
| 5,199,784 | A | | 4/1993 | Hempleman | 362/294 |
| 5,434,765 | A | | 7/1995 | Kelly et al. | 362/274 |
| D384,769 | S | * | 10/1997 | Holten | D26/118 |
| 5,690,424 | A | * | 11/1997 | Warshauer et al. | 362/373 |
| 5,908,234 | A | * | 6/1999 | Kreeft | 362/223 |
| 6,029,939 | A | * | 2/2000 | Lin | 248/346.03 |
| 6,720,566 | B1 | * | 4/2004 | Blandford | 250/504 R |
| 6,787,999 | B1 | * | 9/2004 | Stimac et al. | 315/51 |

OTHER PUBLICATIONS

Website Printout—Lutrex: TORX. 2000 Lutrex Inc.; www.lutrex.com (3 pages).
Websitge Printout—Lutrex: TORX, Jan. 2003; www.lutrex.com (4 pages).

* cited by examiner

*Primary Examiner*—John Anthony Ward
(74) *Attorney, Agent, or Firm*—Jansson, Shupe, Munger & Antaramian

(57) ABSTRACT

A housing for a light fixture comprising a body having a sidewall with a plurality of fin-engaging elements and at least one fin removably engaged with at least one of the fin-engaging elements, thereby providing great design adaptability at modest cost. Preferably, one fin differs from another fin in character such as in shape, color, material or indicia displayed on the surface of the fin. A method is also provided for fabricating a light fixture with selective and exchangeable fins whereby selected placement of the fins around the sidewall is possible.

30 Claims, 5 Drawing Sheets

LIGHT FIXTURE WITH FINS

FIELD OF THE INVENTION

This invention is related generally to housing assemblies for industrial light fixtures.

BACKGROUND OF THE INVENTION

Light fixtures found in indoor industrial, commercial, and retail settings typically consist of a housing and a lamp assembly. The housing holds within it the power components needed by the fixture to operate such as the ballast and the capacitor. The lamp assembly often may consist of a lamp socket, a lamp or light source mounted to the socket, and a reflector or refractor to distribute the light from the lamp in a useful and desirable manner.

In the past, light fixtures of this nature were mounted high above the ground by securing the housing to a ceiling or ceiling supports. Such fixtures were usually out of sight and valued primarily on how well they provided illumination. As a consequence, the design of the housing drew upon functional requirements such as the spacing of the components and their need for ventilation rather than upon style.

Today's lighting fixtures, however, are expected to meet the needs of the purchaser that are not just limited to their use as a source of lighting. More and more often light fixtures are seen as one of the elements to be drawn upon by interior decorators to create a desired atmosphere in a given indoor setting. These fixtures are no longer hidden by high ceilings but are suspended from the ceiling to be closer to workers and customers. Many fixtures are even found being mounted to the surrounding walls. As a result, light fixtures are quite often being chosen to match or contrast with the room or building's decor. They may also be called upon to assist in establishing or projecting a certain corporate image for the purchaser such as by their choice of color or by their display of specific icons or logos.

Even many light fixtures that could be considered stylish have their shortcomings. Customers of lighting fixtures, like those of any product, demand timely delivery of the goods they order. Keeping the time needed, therefore, to fill and deliver a customer's order to a minimum is critical. This has meant limited choices for the customer since any customization of the light fixture has to be performed at the time of assembly. Moreover, any such customization can oftentimes be quite time consuming, increasing the cost to both the manufacturer and customer. This has naturally been a source of some dissatisfaction to many customers who have grown accustomed over the years to being able to choose from a wide selection for nearly any other product they buy.

Another shortcoming with the more stylish lighting fixtures is the fact that their appearance after purchase is fixed. If the room or area around the fixture is later remodeled or redesigned, its particular look may no longer be desirable. On the other hand, replacement of the fixture would be in most cases cost prohibitive. A lighting fixture then that can be customized at any time, to meet the needs of the purchaser for the particular setting where it is being used, would be highly desirable.

A lighting fixture is therefore needed having features that can be easily customized or changed to reflect the tastes or decorative sensibilities of the purchaser. A lighting fixture is also needed where such customization can be done inexpensively so that individual lines of light fixtures targeting different but select customer groups can be developed economically. In particular, there are significant benefits in having a light fixture that can be manufactured at a low cost and yet includes features that allow one model to reflect the colors of a local school or sports team in a specific part of the country while a different unit can be made to display the logo of a certain corporation. This invention meets these needs and overcomes other problems and shortcomings in the prior art.

OBJECTS OF THE INVENTION

It is a primary object of this invention to provide an improved lighting fixture that overcomes some of the problems and shortcomings of the prior art.

Another object of this invention is to provide an improved lighting fixture allowing for great versatility in appearance in a very economic manner.

Another object of this invention is to provide a novel lighting fixture where the appearance of the lighting fixture can be easily customized at any time.

Another object of this invention is to provide an exceptional lighting fixture that can be easily fabricated to achieve a variety of ornamental designs using selective and exchangeable fins.

Another object of this invention is to provide an excellent lighting fixture having a plurality of fins selectively placed around its housing, using fins differing from one another in shape, color, material, or surface indicia.

Another object of the invention is to provide a desirable light fixture that permits a level of customization that meets the particular decorative needs of the purchaser and yet is simple to construct, easy to maintain, and highly reliable to operate.

SUMMARY OF THE INVENTION

This invention is an improvement in housings for lighting fixtures. The light fixture housing of this invention comprises a body having a sidewall where the sidewall has a plurality of fin-engaging elements and at least one fin, preferably a plurality of fins, removably engaged with at least one of the fin-engaging elements. It is desirable that the body be formed by an extrusion process.

In certain desired embodiments, the number of fins is equal to the number of fin-engaging elements. In more preferred embodiments, there are fewer fins than fin-engaging elements, the fins being selectively placed around the sidewall. For example, the number of fins may be half of the number of fin-engaging elements with the fins engaged with every other fin-engaging element.

In some highly preferred embodiments, at least one fin differs from another fin in shape, color, or material. In other desirable cases, one or more fins have a surface that displays indicia, such as a decorative feature or corporate logo.

Certain preferred embodiments find the fin-engaging elements to be slots formed in the sidewall. More preferred is where the sidewall is radially symmetrical about a central axis. In some desirable cases, the sidewall is substantially cylindrical. Highly preferred embodiments find the slots being placed equidistantly around the circumference of a radially symmetrical sidewall.

In a most desirable embodiment, the sidewall has an interior surface and each slot is formed to slideably receive and engage a fin having at least one stop extending from a rear edge. Each stop engages the interior surface and holds a fin in place when the fin is inserted into one of the slots. With these embodiments, it is preferred that each slot have a catch attached to the interior surface where the catch is sized to receive and hold the stop. Moreover, it is desirable that each slot run substantially the length of the sidewall and that the stop be a pair of flanges and the catch be a channel running the length of the slot whereby the flanges are slidably received and engaged by the channel. Highly preferred is where each channel has two ends and a set screw is inserted in at least one of the ends between the channel and one of the flanges so that each fin is secured firmly in position in the channel.

In certain embodiments, the body has a body top-edge and a body bottom-edge. A top cap is fastened to the body top-edge and a bottom cap is fastened to the body bottom-edge. Power-related components such as a ballast and a capacitor are secured within the enclosed space of the housing defined by the sidewall, top cap, and bottom cap.

In another preferred embodiment, at least one fin is made from translucent material and a strip that includes a series of LED elements is secured between that fin and the channel. In this manner, light from the strip is received and captured by the fin.

Certain desired embodiments find the sidewall, preferably one that is substantially cylindrical, having an outer surface where the fin-engaging elements are grooves extending along that outer surface. Most desirable is when the grooves are coplanar with the central axis of the body.

A highly preferred embodiment is where the grooves are formed to slideably receive and engage the fins and each fin has first and second tabs extending from opposite ends of a rear edge. A cap-rim fastened to the top-edge of the body is sized to receive and capture each of the first tabs. Likewise, a collar-rim fastened to the bottom-edge of the body is sized to hold each of the second tabs. In this manner, the fins are held in place by the cap-rim and the collar-rim. Most desirable is where the cap-rim has a number of cap-apertures and the collar-rim has a plurality of collar-apertures. In these embodiments, each cap-aperture is in registry with one of the grooves and one of the collar-apertures and each aperture is formed to receive and engage one of the tabs.

A method is also provided by this invention for fabricating a light fixture with selective and exchangeable fins. The method comprises providing a body having a sidewall where the sidewall has a plurality of fin-engaging elements and engaging at least one fin with at least one of the fin-engaging elements. Most preferred is when the method further includes the step of choosing the at least one fin from a group of fins of differing character. For example, the fins in this group may differ in shape or color, they could be made from different materials, or they could have different indicia on their surfaces. Highly preferred is where the number of fins is less than the number of fin-engaging elements so that selected placement of the fins around the sidewall is possible.

DETAILED DESCRIPTION OF PREFERRED EMBODIMENTS

The drawings illustrate preferred embodiments of a light fixture housing 10 in accordance with this invention.

Figure 1:
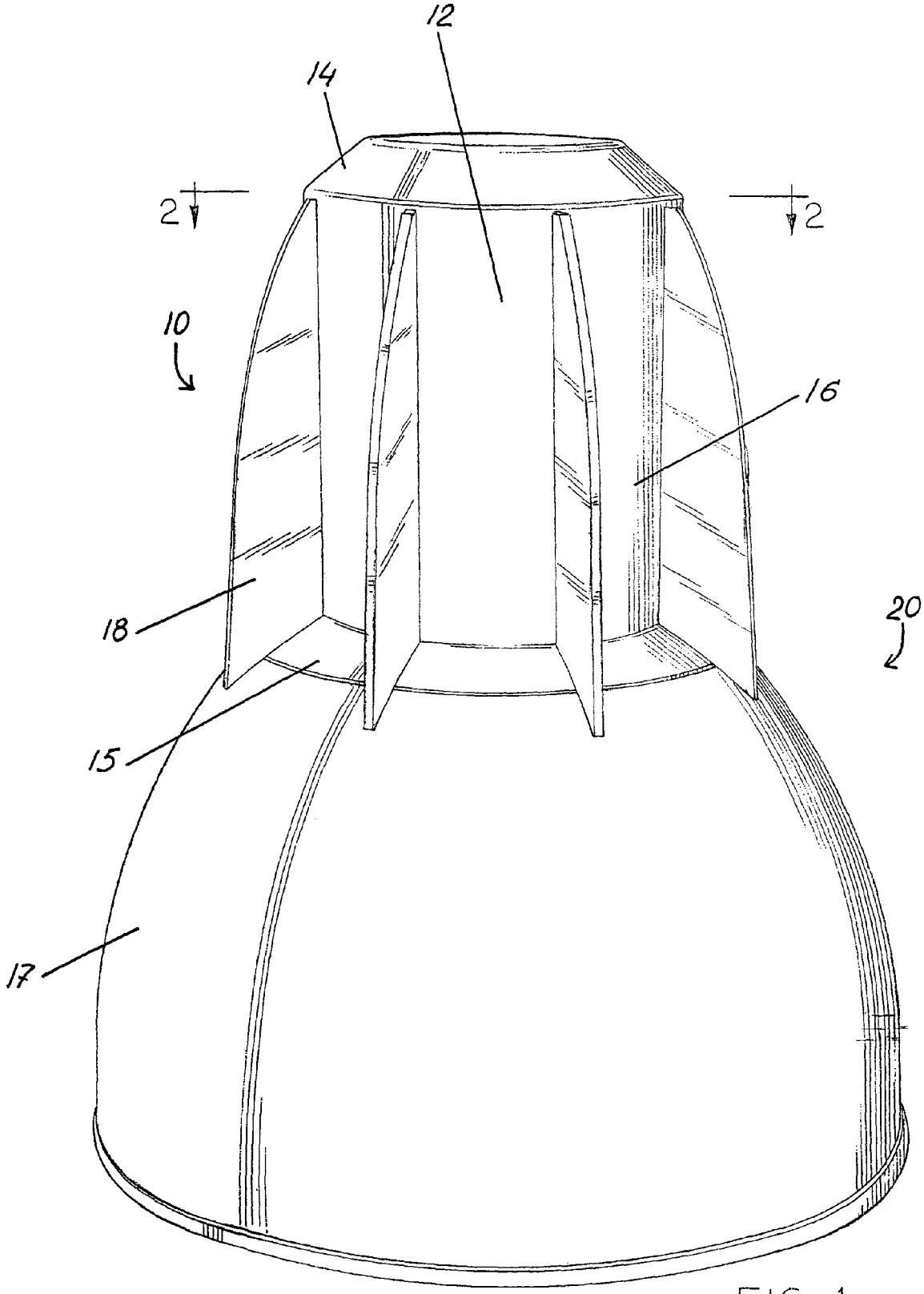
FIG. 1 is a perspective view of a preferred light fixture in accordance with this invention.

As seen in FIG. 1, housing 10 has a body 12, a top cap 14, and a bottom collar 15. Body 12 includes sidewall 16 and bottom 19. Reflector 17 is securely mounted to bottom collar 15 beneath housing 10 to comprise light fixture 20. A plurality of fins 18 are removably engaged to sidewall 16.

Figure 2:
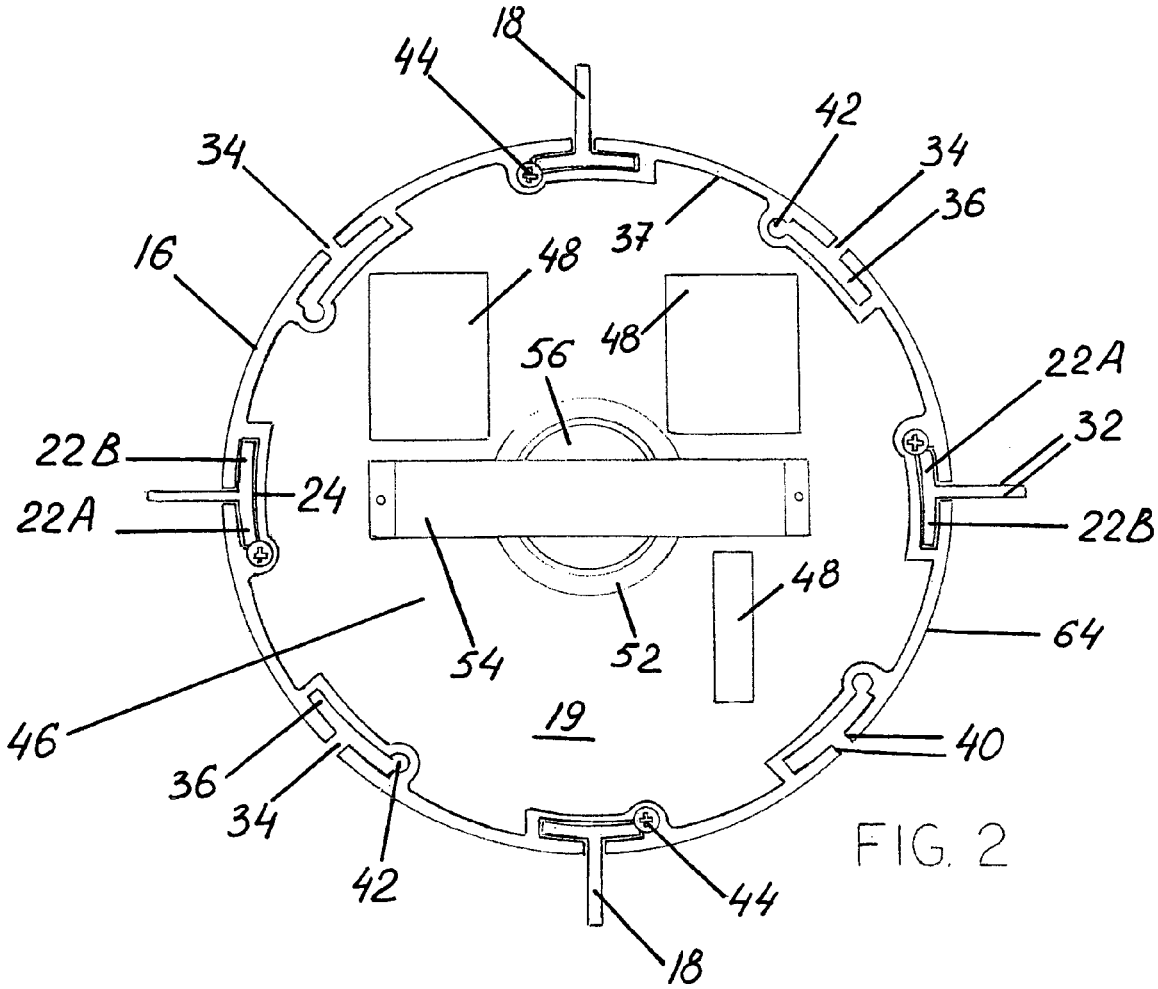
FIG. 2 is a cross-sectional view of a schematic representation of a light fixture housing in accordance with this invention taken substantially along the plane of line 2—2 of FIG. 1.
Figure 3:
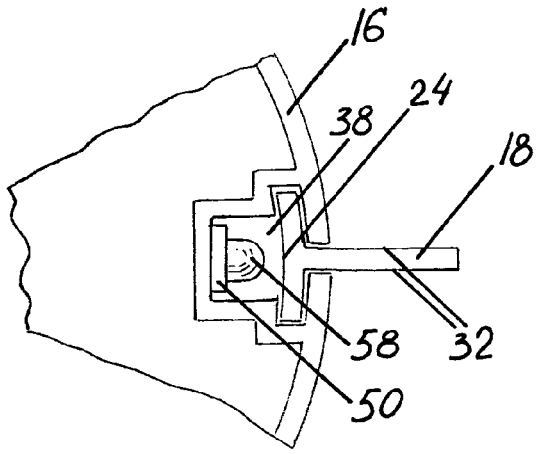
FIG. 3 is a fragmentary cross-sectional view of another preferred light fixture housing in accordance with this invention taken substantially along the plane of line 2—2 of FIG. 1 having an LED-strip adjacent to each fin.

In one embodiment, as illustrated in FIGS. 2 and 3, each fin 18 has a pair of flanges 22A, 22B extending orthogonally from opposite fin-surfaces 32 adjacent to the rear edge 24 of fin 18. In another embodiment shown in FIG. 4, each fin 18 has two tabs 26, 28 extending outwardly from opposite ends of rear edge 24.

Figure 6E:
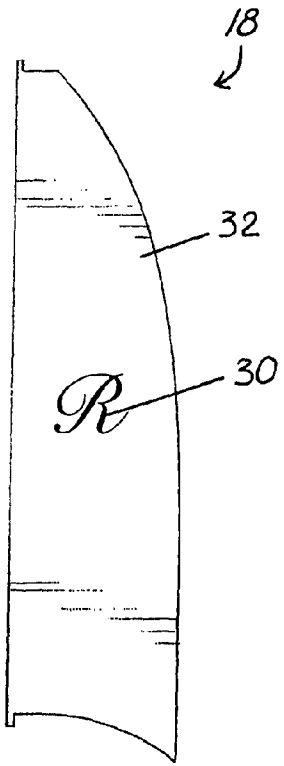
FIG. 6E is a schematic representation of a fin in accordance with this invention showing an alternative form of indicia on the surface of the fin.
Figure 6D:
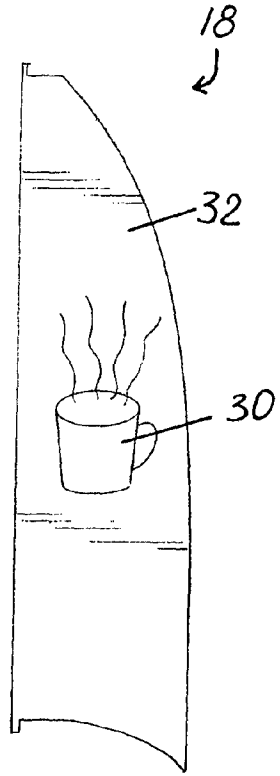
FIG. 6D is a schematic representation of a fin in accordance with this invention showing indicia on the surface of the fin.
Figure 6C:
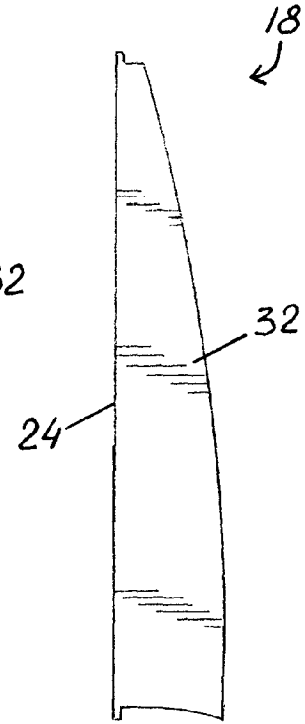
FIG. 6C is a schematic representation of a fin in accordance with this invention showing an alternative shape for the fin.
Figure 6B:
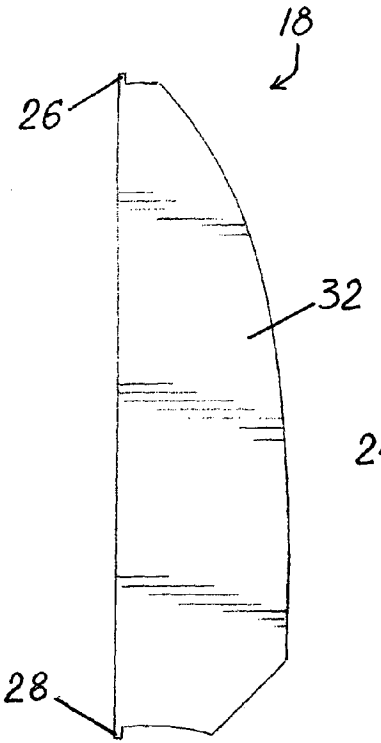
FIG. 6B is a schematic representation of a fin in accordance with this invention showing another choice of shape for the fin.
Figure 6A:
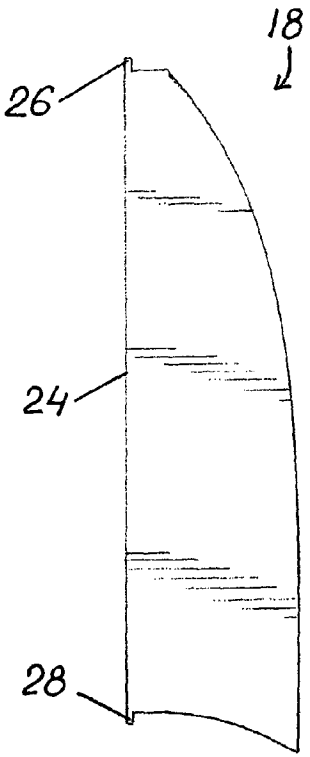
FIG. 6A is a schematic representation of a fin in accordance with this invention showing a choice of shape for the fin.

In either embodiment, fins 18 can differ from each other in character such as in color or material. FIGS. 6A–6C show how fins 18 may also differ from one another in shape. Likewise, FIGS. 6D–6E illustrate how certain other fins 18 may differ by the indicia 30 displayed on fin-surfaces 32. It is understood that indicia 30 can be displayed on either or both fin-surfaces 32. It is further understood that fins 18 can differ from one another based upon the variety of available combinations arrived at by permutations of color, space, material, and indicia.

In FIG. 2, it will be seen that sidewall 16 is substantially cylindrical. Sidewall 16 defines a plurality of substantially identical fin-engaging slots 34. Slots 34 are spaced equidistantly around the circumference of sidewall 16.

Each slot 34 opens into a channel 36 rigidly attached to the interior surface 37 of sidewall 16 and running the length of sidewall 16. Slot 34 and channel 36 are sized to slideably receive fin 18. It will be appreciated that the cross-sectional dimensions of channel 36 are sized so as to permit fitted engagement of flanges 22A, 22B within channel 36. Likewise, slot 34 is sized to frictionally hold fin 18 between slot-walls 40.

At one end of each channel 36 is a screw-receiving aperture 42. A set screw 44 is threaded into screw-receiving aperture 42 at slots 34 holding a fin 18. Set screw 44 secures fin 18 firmly in position within slot 34 by tightening the contact between channel 36 with flanges 22A, 22B.

Top cap 14, bottom 19 and sidewall 16 define a substantially enclosed interior 46 within housing 10. FIG. 2 represents how power components, shown generally as 48, are secured with respect to sidewall 16 and bottom 19 within interior 46. Power components include ballasts, capacitors, ignitors and other devices needed to create the proper electrical power for the high-intensity discharge lamps that are standard in most commercial and industrial light fixtures. Fins 18 may be made from metals that facilitate the dissipation of the heat generated by power components 48.

The bottom 19 of body 12 defines socket-window 52. Lamp-mounting socket 56 is received by socket-window 52 and secured to bottom 19 by means of socket-bracket 54. The lamp (not shown) for light fixture 20 is mounted to socket 56 which is electrically connected to power components 48.

In an alternative embodiment illustrated in FIG. 3, channel 36 includes LED-chamber 38. LED-chamber 38 preferably runs the length of housing 10. An LED-strip 50 of light emitting diode (LED) elements 58 is secured within LED-chamber 38. (An LED element 58 shown in FIG. 3 masks other elements on LED-strip 50 that are beneath it.) LED-strip 50 is used in combination with a fin 18 made from a translucent material. It can be appreciated that light from LED-strip 50 will illuminate translucent fins from within housing 10 in a manner such that the fins are given a distinct glowing appearance.

Figure 4:
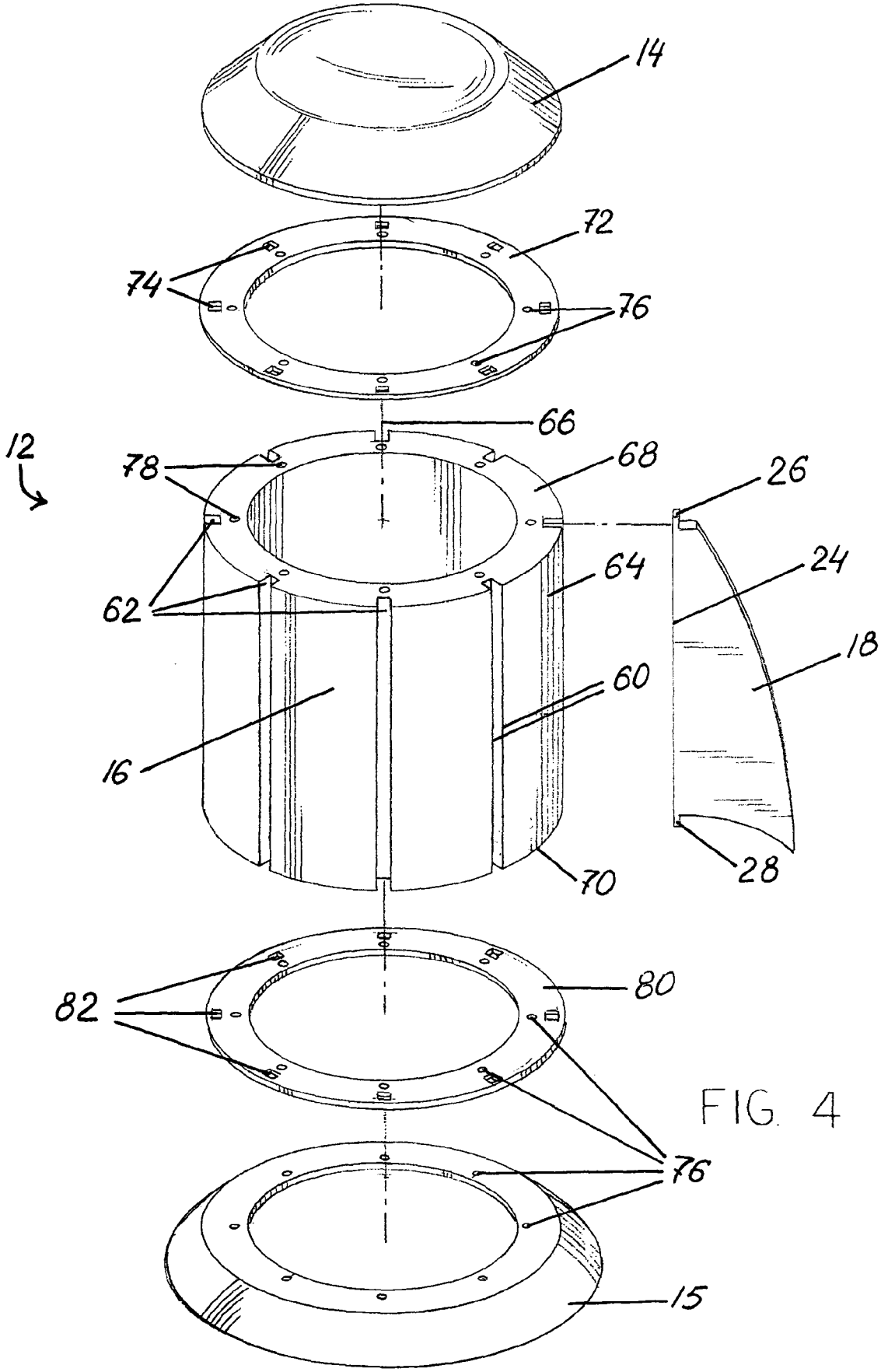
FIG. 4 is an exploded view of an other preferred light fixture housing in accordance with this invention having fins with outwardly extending tabs.

Another preferred embodiment of the present invention is seen in FIG. 4. In this embodiment, fin-engaging grooves 62 are defined by the exterior surface 64 of sidewall 16. Grooves 62 are sized to slidably receive and firmly grip fins 18 between groove-walls 60.

Sidewall 16 is substantially cylindrical about central axis 66. Each groove 62 is coplanar with central axis 66. Grooves 62 are substantially identical and spaced equidistantly about the circumference of sidewall 16.

Body 12 is provided with a top-edge 68 and a bottom-edge 70. Top cap 14 is in fitted engagement to sidewall 16 along top-edge 68. Top cap 14 covers cap-rim 72. Cap-rim 72 is provided with a plurality of cap-apertures 74 and a plurality of fastener-apertures 76. The number of fastener-apertures 76 may, but need not be, equivalent to the number of cap-apertures 74.

Cap-rim 72 is fastened to top-edge 68 by inserting a fastener (not shown) through each fastener-aperture 76 and into threaded engagement with aligned fastener-receptors 78 on top-edge 68. It is seen that cap-apertures 74 are located on cap-rim 72 so that when cap-rim 72 is secured to sidewall 16, each cap-aperture 74 is in registry with a different groove 62. In this manner, first tab 26 on any fin 18 mounted within a groove 62 is received and held in place by the corresponding cap-aperture 74.

Bottom collar 15 is fastened with collar-rim 80 to sidewall 16 along bottom-edge 70. Collar-rim 80 is provided with a plurality of collar-apertures 82 and a plurality of fastener-apertures 76. As with cap-rim 72, the number of fastener-apertures 76 need not be the same as the number of collar-apertures 82. Bottom collar 15 has a plurality of fastener-apertures 76 that correspond in number to those on collar-rim 80.

Bottom collar 15 along with collar-rim 80 are secured to sidewall 16 by inserting a fastener (not shown) through each fastener-aperture 76 on bottom collar 15, through an aligned fastener-aperture 76 on collar-rim 80, and then into threaded engagement with aligned fastener-receptors 78 on bottom-edge 70. As with cap-rim 72, collar-apertures 82 are positioned on collar-rim 80 to be in registry with each groove 62 when collar-rim 80 is fastened to bottom-edge 70. In this manner, second tab 28 on each fin 18 placed in grooves 62 is received and captured by a corresponding collar-aperture 82.

Figure 5A:
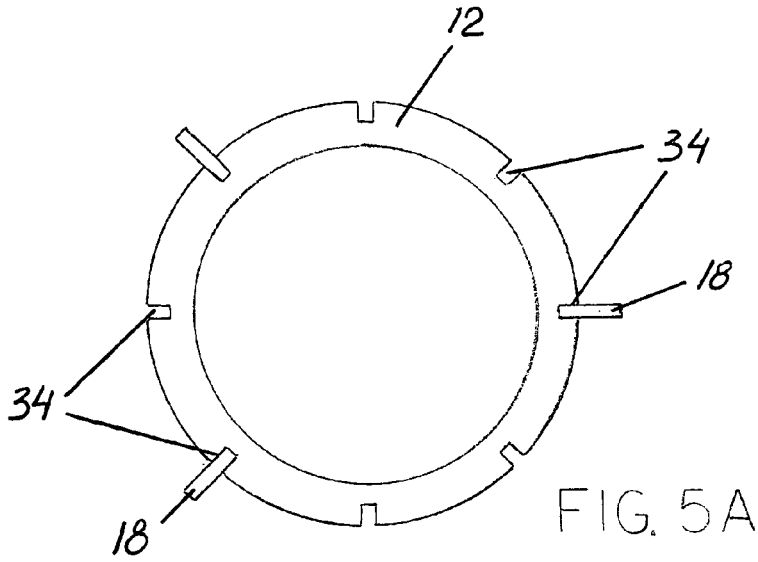
FIG. 5A is a schematic representation of a light fixture housing in accordance with this invention in cross-section, showing selective placement of fins in only three of the available eight fin-engaging slots.
Figure 5B:
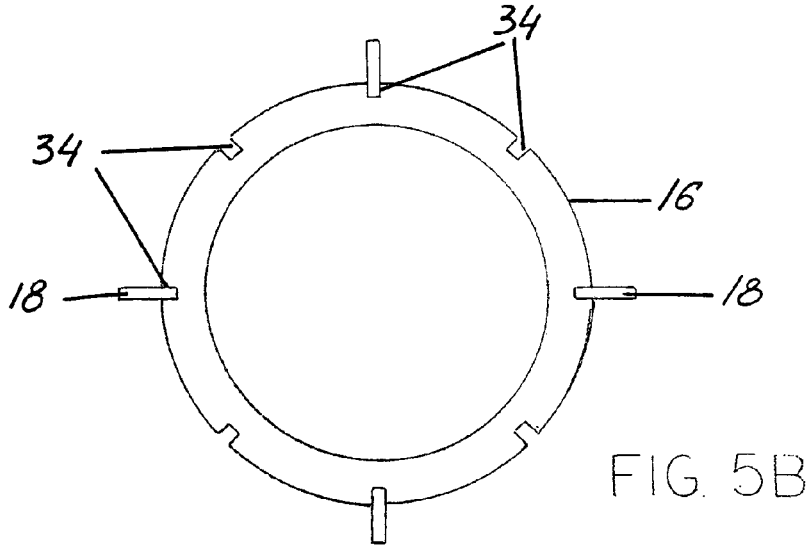
FIG. 5B is a schematic representation of a light fixture housing in accordance with this invention in cross-section, showing selective placement of fins in only four of the available eight fin-engaging slots.
Figure 5C:
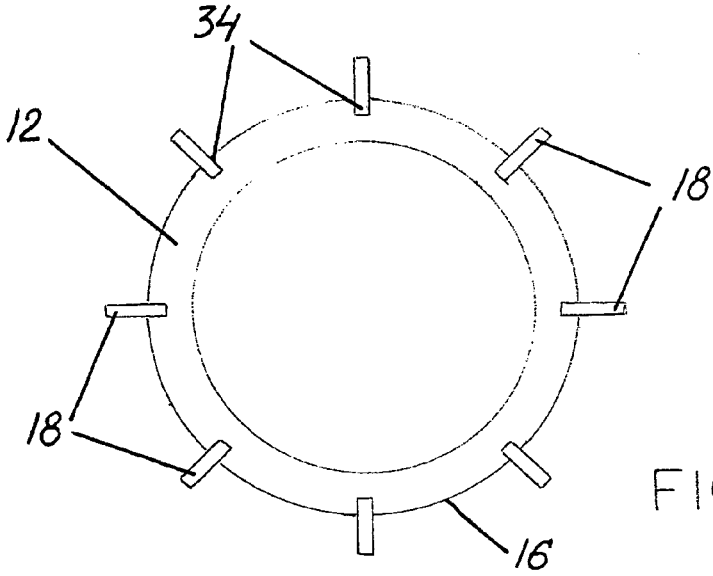
FIG. 5C is a schematic representation of a light fixture housing in accordance with this invention in cross-section, showing selective placement of fins in each of the available eight fin-engaging slots.

FIGS. 5A–5C demonstrate how selected placement of fins 18 around sidewall 16 is possible. Where sidewall 16 is provided with eight fin-engaging grooves 62 as shown, fins 18 (that can differ from one another in shape, color, material or surface indicia) may be inserted in three (FIG. 5A), four (FIG. 5B) or all eight (FIG. 5C) of the available grooves.

If the configuration seen in FIG. 5A should be selected, the manner in which each fin 18 is removably mounted within grooves 62 of housing 10 easily permits a different configuration (such as the one seen in FIG. 5C) to be selected at some later date. In addition, the user is free to select different types of fins 18 as well. In this fashion, a novel light fixture with a varying number and pattern of exchangeable and differing fins is achieved.

The various parts of housing 10 shown in the drawings and described above are preferably formed by an extrusion process. It will be apparent to one skilled in the art, however, that the housing may be fabricated using a variety of materials and a variety of production procedures. Moreover, while weights, shapes and sizes of all parts can vary greatly depending upon the particular application being made of the housing, such changes may be fully accommodated by a housing assembly configuration in accordance with this invention.

While the principles of the invention have been shown and described in connection with specific embodiments, it is to be understood that such embodiments are by way of example and are not limiting.

The invention claimed is:

1. A housing for a light fixture comprising:

a body having a sidewall, the sidewall having exterior and interior surfaces and a plurality of fin-engaging elements, the interior surface defining an interior space;

power-related components secured with respect to the housing within the interior space; and at least one fin removably engaged with at least one of the fin-engaging elements and extending outward from the exterior surface.

2. The housing of claim 1 further comprising a plurality of fins.

3. The housing of claim 2 wherein the plurality of fins is equivalent to the plurality of fin-engaging elements.

4. The housing of claim 2 wherein the plurality of fins is less than the plurality of fin-engaging elements, whereby the fins are selectively placed around the sidewall.

5. The housing of claim 2 wherein at least one fin differs from another fin in shape, color, or material.

6. The housing of claim 2 wherein at least one fin has a surface displaying indicia.

7. The housing of claim 2 wherein the fin-engaging elements are slots formed in the sidewall.

8. The housing of claim 7 wherein the sidewall is radially symmetrical about a central axis.

9. The housing of claim 8 wherein the sidewall is substantially cylindrical.

10. The housing of claim 9 wherein the slots are placed equidistantly around the circumference of the sidewall.

11. The housing of claim 7 wherein:

each slot is formed to slideably receive and engage each fin; and each fin has at least one stop extending from a rear edge, each stop engaging the interior surface and holding the fin in place when the fin is inserted into at least one of the slots.

12. The housing of claim 11 wherein each slot has a catch attached to the interior surface, each catch being sized to receive and hold the stop.

13. The housing of claim 12 wherein:

each slot runs substantially the length of the sidewall;

the stop is a pair of flanges; and the catch is a channel that runs the length of the slot, whereby the channel slidably receives and engages the flanges.

14. The housing of claim 13 wherein:

each channel has two ends; and a set screw is inserted in at least one of the ends between the channel and at least one of the flanges engaged by the channel, whereby each fin is secured firmly in position in the channel by the set screw.

15. The housing of claim 14 wherein:

the body has a body top-edge and a body bottom-edge;

a top cap is fastened to the body top-edge;

a bottom cap is fastened to the body bottom-edge; and the sidewall, top cap, and bottom cap substantially enclose the interior space.

16. The housing of claim 13 further comprising:

at least one strip, the strip including a series of LED elements;

at least one fin is made from translucent material; and the strip is secured between the at least one fin and at least one channel, whereby light from the strip is received by the fin.

17. The housing of claim 2 wherein the fin-engaging elements are grooves extending along the exterior surface.

18. The housing of claim 17 wherein the sidewall is substantially cylindrical.

19. The housing of claim 17 wherein:

each groove is formed to slideably receive and engage each fin;

the body has a body top-edge and a body bottom-edge;

each fin has a first tab and a second tab extending from opposite ends of a rear edge;

a cap-rim is fastened to the body top-edge, the cap-rim being sized to receive and capture each of the first tabs; and a collar-rim is fastened to the body bottom-edge, the collar-rim being sized to receive and capture each of the second tabs, whereby each fin is held in place by the cap-rim and the collar-rim.

20. The housing of claim 19 wherein the cap-rim has a plurality of cap-apertures and the collar-rim has a plurality of collar-apertures, each cap-aperture being in registry with one of the grooves and one of the collar-apertures and each cap-aperture and each collar-aperture being formed to receive and engage one of the tabs.

21. The housing of claim 17 wherein each of the grooves is coplanar with a central axis of the body.

22. The housing of claim 1 wherein the body is formed by an extrusion process.

23. A method for fabricating a light fixture with selective and exchangeable fins comprising:

providing a body having a sidewall, the sidewall having exterior and interior surfaces and a plurality of fin-engaging elements, the interior surface defining an interior space having power-related components secured with respect to the fixture therein; and removably engaging at least one fin with at least one of the fin-engaging elements, the fin extending outward from the exterior surface.

24. The method of claim 23 further comprising the step of choosing the at least one fin from a group of fins of differing character.

25. The method of claim 23 wherein there is a plurality of fins less than the plurality of fin-engaging elements, whereby selected placement of the fins around the sidewall is possible.

26. A housing for a light fixture comprising:

a body having a sidewall, the sidewall having an interior surface and a plurality of slots formed in the sidewall, each slot running substantially the length of the sidewall and having a channel attached to the interior surface that runs the length of the slot;

a plurality of fins, each fin having a pair of flanges extending from a rear edge and being removably engaged with at least one of the slots, each slot being formed to slidably receive and engage each fin, the flanges engaging the interior surface and being slidably received and engaged by the channel to hold the fin in place, and at least one strip, the strip including a series of LED elements and being secured between at least one fin made from translucent material and at least one channel such that light from the strip is received by the fin.

27. A housing for a light fixture comprising:

a body having a top-edge, a bottom-edge and a sidewall, the sidewall having a plurality of fin-engaging elements;

at least one fin removably engaged with at least one of the fin-engaging elements;

a top cap fastened to the top-edge and a bottom cap fastened to the bottom-edge, the top cap, bottom cap and sidewall defining a substantially enclosed space; and power-related components secured with respect to the housing within the enclosed space.

28. The housing of claim 27 wherein the sidewall has an interior surface and the fin-engaging elements are slots formed in the sidewall, each slot running substantially the length of the sidewall and having a channel attached to the interior surface that runs the length of the slot, and the housing further includes a plurality of fins, each fin having a pair of flanges extending from a rear edge, each slot being formed to slidably receive and engage each fin, the flanges engaging the interior surface and being slidably received and engaged by the channel.

29. The housing of claim 27 wherein the sidewall has an exterior surface and the fin-engaging elements are grooves extending along the exterior surface, and the housing further includes: a plurality of fins, each fin having a first tab and a second tab extending from opposite ends of a rear edge and each groove being formed to slidably receive and engage each fin; a cap-rim fastened to the top-edge and sized to receive and capture each of the first tabs; and a collar-rim fastened to the bottom-edge and sized to receive and capture each of the second tabs such that each fin is held in place by the cap-rim and collar-rim.

30. The housing of claim 29 wherein the cap-rim has a plurality of cap-apertures and the collar-rim has a plurality of collar-apertures, each cap-aperture being in registry with one of the grooves and one of the collar-apertures and each cap-aperture and each collar-aperture being formed to receive and engage one of the tabs.

* * * * *